United States Patent [19]

Tholander et al.

[11] 4,074,641

[45] Feb. 21, 1978

[54] SEWING MACHINE

[76] Inventors: Lars Helge Gottfrid Tholander, Fagelstigen 7; Kenneth Oscar Emanuel Skogward, Oxhagsgatan 147, both of Huskvarna, Sweden, S-56100

[21] Appl. No.: 585,564

[22] Filed: June 10, 1975

[30] Foreign Application Priority Data

June 13, 1974 Sweden ..... 7407800

[51] Int. Cl.[2] ..... D05B 3/02

[52] U.S. Cl. ..... 112/158 D; 112/158 E

[58] Field of Search ..... 112/158 E, 158 D, 158 A, 112/158 B, 158 R, 157; 74/56

[56] References Cited

U.S. PATENT DOCUMENTS 3,812,729 5/1974 Ketterer ..... 112/158 D X 3,929,081 12/1975 Ketterer ..... 112/158 E X

*Primary Examiner*—Werner H. Schroeder

*Assistant Examiner*—Peter Nerbun

[57] ABSTRACT

A sewing machine is provided with a needle bar movable substantially vertically and capable of being pivoted laterally about a horizontal axis, a crank mechanism for operating the needle bar connected to a drive shaft, a thread hooking means beneath the needle bar, a shuttle mechanism operable in conjunction with the needle bar to form a stitch, and a reciprocable cloth feeding means in which lateral pivoting of the needle bar and/or the feeding movements effected by the cloth feeding means is or are produced by a code converter for converting a variable binary code to mechanically controlled movements determined by setting means and drive means arranged in the converter.

7 Claims, 9 Drawing Figures

B-B

C—C

SEWING MACHINE

FIELD OF THE INVENTION

The present invention relates to sewing machines of the type which comprise a laterally pivotable needle bar and a workpiece feed means, and which are provided with control means responsive to electric signals for effecting the lateral pivoting movement of the needle bar and/or for movement of the feeding means.

BACKGROUND OF THE INVENTION

From the time of the first sewing machine, the needle bar and the feeding means have been moved by means of mechanical devices, such as eccentrics, linkage-systems, cam plates and cam followers. As the technique in the design of sewing machines has enabled sewing patterns of an increasing complexity to be performed, so have the mechanical devices required in connection herewith become more complicated and expensive to manufacture. To enable a more versatile machine to be developed, it has been necessary to provide alternatives to the before-mentioned mechanical devices, these devices hitherto being the only auxiliary devices provided for effecting the movements of the pattern-forming devices.

SUMMARY AND OBJECTS OF THE INVENTION

The subject of the present invention is a sewing machine in which there is provided a stitch-forming means in the form of a needle-bar mechanism and a shuttle mechanism. These mechanisms are preferably driven from the main shaft of the machine and may be of simple, conventional design. The pattern-forming means, which comprises a feed mechanism, stitch-field mechanism and a stitch-size control mechanism, executes a complicated pattern of movements and exerts a large number of forces, these movements and forces being controlled by a central control unit. A sewing machine of advanced design can be set to make many different standard seams; with machines of a less advanced design this requires a large number of manipulations to be effected manually by different control means. These manipulations can be eliminated by providing a central control unit which is adapted to receive some form of data record medium which carries information concerning the task to be performed on the machine.

The advantages afforded hereby and those advantages afforded by a machine of simple construction, can be obtained from a sewing machine pattern-forming means which is driven by a code converter and the central unit of which machine comprises electronic control circuits which, in response to a data record medium are able to control setting means in the code converter which in conjunction therewith causes adjustments to be made to the movement of the needle and cloth feeding means. Such a code converter is the subject of our co-pending Patent Application "Converter."

This invention consists in a sewing machine having a needle bar which is moveable in a substantially vertical direction and which is capable of being pivoted laterally about a horizontal axis, a crank-mechanism which is arranged to operate said needle bar and which is connected to a drive shaft arranged in the machine, a thread-gripping means arranged beneath the needle bar, a shuttle mechanism which is arranged to be operated in conjunction with the needle bar to form a stitch, and a reciprocatingly moveable cloth-feeding means, wherein the lateral pivoting movement of the needle bar and/or the feeding movements effected by the cloth-feeding means is or are produced by means of a code converter for converting a variable binary code to decimal starting magnitudes determined by setting means and drive means arranged in the code converter, in dependence upon a central control unit which comprises coding means for transmitting binary coded signals to the converter.

So that the invention will be more readily understood and further features thereof made apparent, an exemplary embodiment of the invention will now be described with reference to the accompanying drawings, in which,

DESCRIPTION OF PREFERRED EMBODIMENTS

Figure 1:
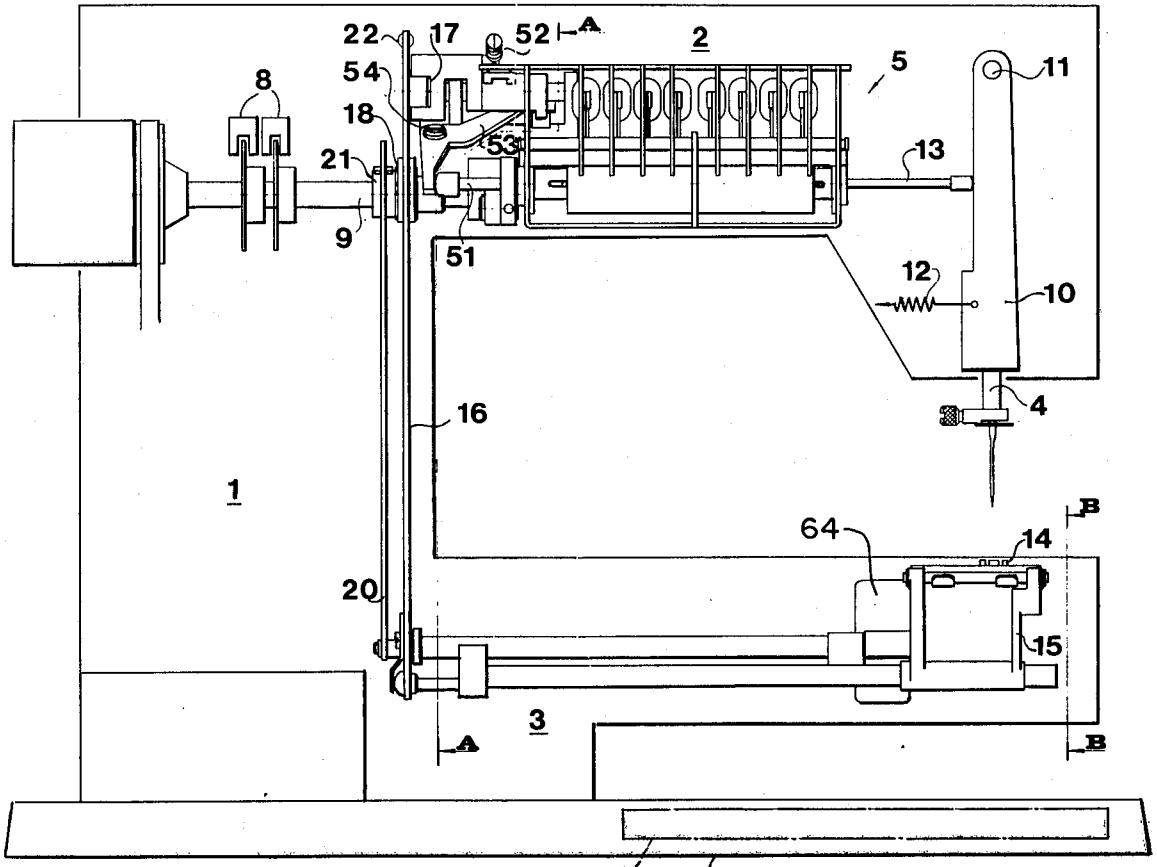
FIG. 1 is a vertical projection of a sewing machine constructed in accordance with the invention, with the rear side of the sewing machine and a number of machine elements not essential to the invention being omitted from the Figure.
Figure 3:
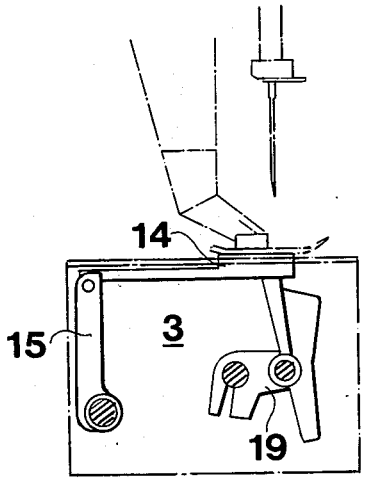
FIG. 3 is a sectional view taken along the line B—B in FIG. 1 and shows diagrammatic view of the workpiece feeding mechanism.

In FIG. 1 there is shown diagrammatically a sewing machine comprising a pillar 1, an upper and a lower arm 2, 3, drive means and drive transmissions. For the purpose of feeding the cloth to effect a sewing operation, a feed mechanism (FIG. 3) is arranged in the lower arm 3, while a zig-zag mechanism is provided in one end of the upper arm 2 to provide for the lateral pivoting movements of the needle bar 4. Arranged in a bottom plate 7 is a central control unit 6, which, among other things, comprises a program selector which can be activated from without via a set of push-buttons, knobs or the like arranged on the side of the machine facing the user. The control unit is adapted to receive pulses from a sensor/-pulse emitter 8, arranged on and adjacent to a shaft 9 arranged in the upper arm 2. The needle bar is journalled in an arm 10, for swinging movement about a pivot point 11 which supports the needle bar mechanism. The needle bar is operated in a conventional manner by a crank arranged at the end of the shaft 9, to which a sewing thread tightening means (not shown) is connected. The arm 10 is biassed in one direction by a spring 12 which, with the illustrated embodiment, sets the needle bar in its left starting position. The zig-zag movements effected by the needle bar are guided from said starting position in a varying pattern by means of a pressure rod 13 extending from the code converter 5.

Figure 2:
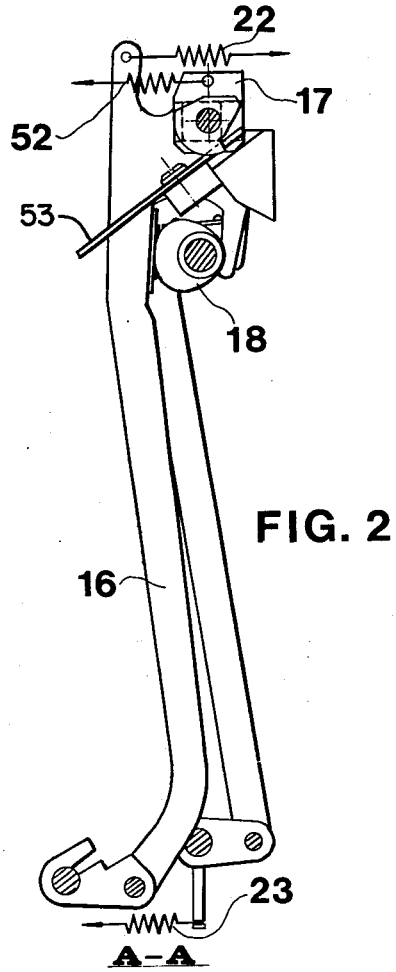
FIG. 2 is a sectional view taken along the line A—A in FIG. 1 and shows a pair of links forming part of the machine.

As with conventional machines, arranged in the lower arm is a shuttle mechanism 64, a workpiece feeding means 14 and a stitch plate. These elements are generally known and need not be described. The feedng means 14 is arranged to execute a substantially rectangular pattern of movement and has two drive means, one for horizontal movement and one for vertical movement. The horizontal movement, which shall be variable, is produced by a system of links 15, 16, a regulatable link member 17 and an eccentric drive means 18 which is arranged on the shaft 9 and which produces a workpiece feed movement. The amount of vertical movement of the feeding means 14 is constant and is produced by a further linkage system 19, 20 and a further eccentric drive means 21 arranged on the shaft 9, which produces an upward movement. The drive means 18 and 21 act in one direction only and the reciprocating movements are obtained by means of springs 22 and 23 respectively (FIG. 2). The aforementioned workpiece feed drive mechanisms are known.

Figure 5:
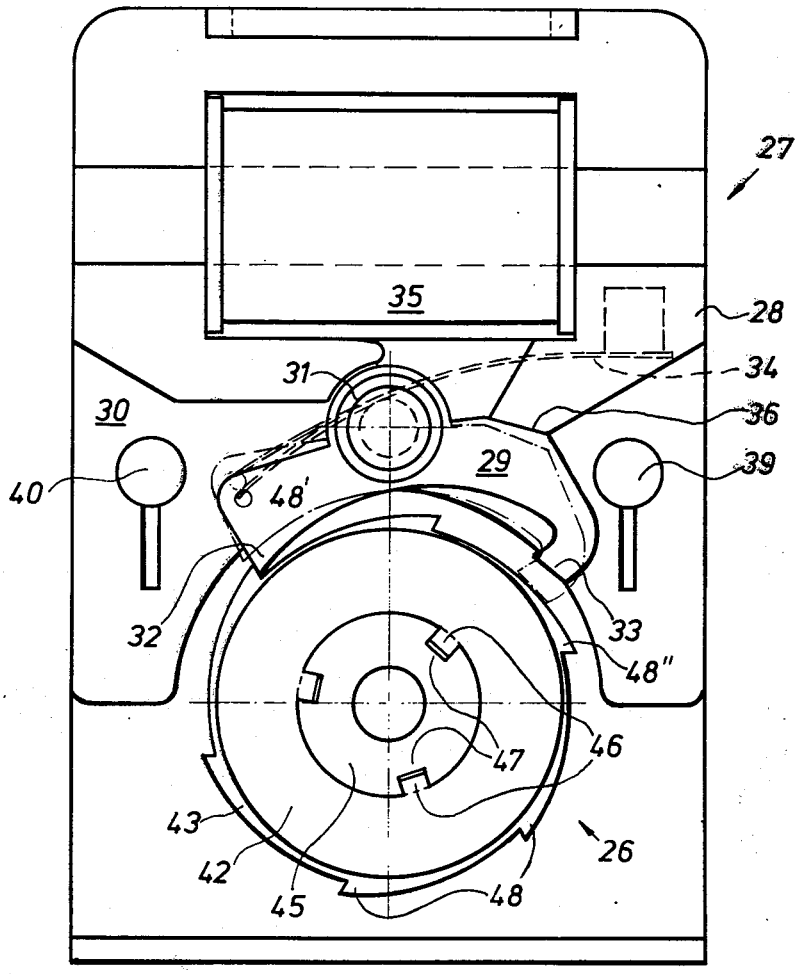
FIG. 5 is a sectional view taken along the line C—C in FIG. 1 and shows diagrammatically a set of cams and a guide element arranged in the code converter.
Figure 9:
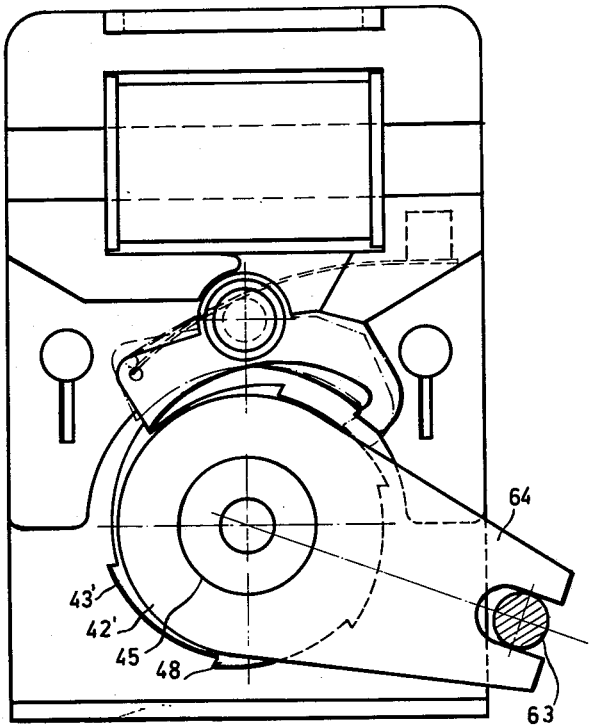
FIG. 9 shows diagrammatically a set of cams and a guide element arranged in the code converter shown in FIG. 7.
Figure 6:
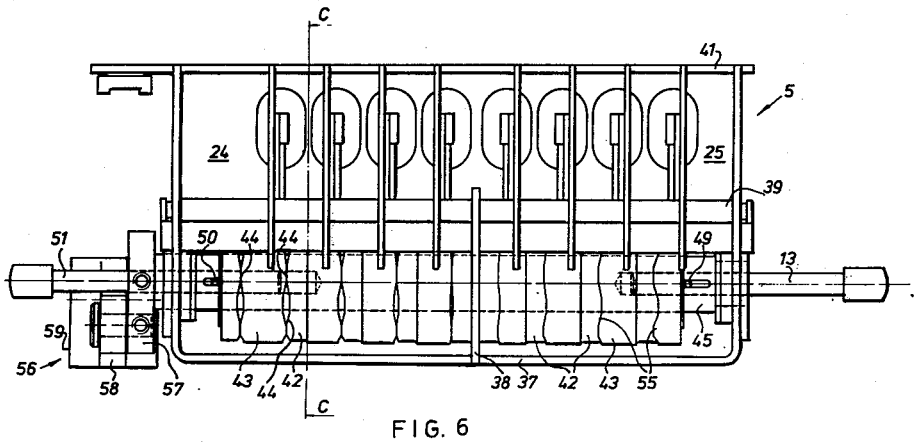
FIG. 6 shows the code converter diagrammatically and in vertical projection.

The aforementioned code converter 5 will now be described with reference to FIGS. 4–6. As will be seen from FIG. 6, the code converter is divided into two sections 24–25, one section for producing zig-zag movements of the needle bar and one section for producing workpiece feeding movements. Each section comprises four adjacently located cam plate sets 26 each of which has a control means 27; one such means being shown in FIG. 5. With the illustrated embodiment, the control means 27 has the form of an electromagnet 28 having an armature 29. In its rest position, the armature occupies the position shown in dotted lines, while the full lines show the position of the armature when activated. The electromagnet is arranged in a frame 30 in which a pin 31 is fixed, the armature being mounted on the pin 31 via two pawls 32, 33. The armature is biassed towards its rest position by a spring 34 and is attracted towards a magnet pole 36 when a coil 35 is energised.

The two sections 24, 25 are contained between the end walls of a stirrup-like structure 37 (FIG. 6) provided with a partition 38. The units shown in FIG. 5 are held in position by two rods 39, 40 and are clamped between these rods and an overlying plate 41 on the stirrup-like structure. Each coil 35 is provided with connecters and is connected to the central control unit from which emits pulses the coil operating current pulses are obtained.

Each set of cam plates 26 comprises two cam plates 42, 43 the two opposing surfaces of which have a wave-shaped configuration, said surfaces serving to cause movement of respective plates towards and away from each other when one plate effects a rotary movement relative to the other. Each crest of the undulating surfaces represents a camming means 44 and the extension of respective camming means, hereinafter referred to as cams, varies from cam-set to cam-set. As the cams of each cam set rotate relative to each other, the cam sets are caused to move axially through distances which are individual to each set of cams; the length of the relative movement in the different cam sets is determined by the expression $2^n$, where $n = 0, 1, 2, 3 \ldots$, i.e. the relative length of movement of the respective cam sets (in each of the sections 24; 25) lies in the ratios of 1:2:4:8. The cam sets are arranged on a tubular shaft 45 and the individual movements effected by the cam sets are added to enable a scale of different lengths of movement between 0 and 15 to be produced in each section 24, 25.

In order that the two cam plates in each cam set shall be moved away from each other, it is necessary for the plates to perform a rotary indexing movement. Consequently, each alternate plate 42 in the sections 24, 25 is provided with studs 46 (FIG. 5) which are recieved in longitudinally extending grooves (splines) 47 in the tubular shaft 45. The other plates 43 are provided externally with a number of teeth 48 which co-act with the pawls 32, 33. When the plate 42 (FIG. 5) is rotated clockwise through one step, which is approximately equal to half a tooth division on the plate 43, the cam plates slide on one or the other plate towards each other and stop "crest" against "crest"; the plates are moved apart through a distance equal to the height of the crest in the cam set in question. During the next indexing step, provided the plate 43 is still latched, the cams will slide over each other so as to bring the opposing surfaces of respective pairs of plates into full engagement with each other.

The cam sets are axially displaceable on the tubular shaft 45 in both sections 24, 25 and are pressed together against the partition 38 by spring forces which act on the outermost plates via transverse pins 49, 50 mounted on the journal pin 13 and 51 respectively; the spring force in section 25 is created by the aforementioned tension spring 12 and in section 24 by a re-setting spring 52 which biases the adjustable link member 17 in one direction. Setting movements are transmitted between the link member 17 and the journal pin 51 by means of an angular lever 53 which is pivotally mounted on a screw 54 arranged in the machine frame. FIG. 6 shows the cam plates of the cam sets in section 24 moved apart and the cam plates of the cam sets in section 25 in a mutually fully engaged position; the different cam heights of the sets being shown by wave-shaped lines 55 between the plates of respective cam sets.

The force required for moving the cam plates of the cam sets apart, in which the plate having teeth 48 is latched, is produced by the tubular shaft 45 which is driven by a crank mechanism 56. The crank mechanism 56 comprises a crank 57 arranged on one end of the tubular shaft and a connecting rod 58, one end of which is ring-shaped and encloses an eccentric 59 on the upper arm shaft 9. Rotary movement of the shaft 9 causes a pivoting movement to be transmitted to the tubular shaft and the plates 42 arranged thereon. The magnitude of this pivoting movement is less than the toothed division on the plate 43; thus, when the plate (FIG. 5) rotates through a complete pivoting movement in an anti-clockwise direction from the shown position, the next following tooth 48' does not reach or pass beyond the pawl 32, but the plates 42, 43 accompany the movement under the action of friction. When the armature 29 is set to the position shown by broken lines and the pivoting movement is effected from the shown position, the tooth 48" engages the pawl 33 and the plates 42, 43 slide against each other during the remainder of the movement. A further setting of the armature causes the panel to catch the nearest tooth and the plate 43 is set to a new position.

The beforedescribed settng means can be caused to effect adjustments in rapid sequence. It is not unusual for a sewing machine to operate at more than 1000 machine revolutions per minute, which means that the cam sets are adjusted in approximately 50 ms. The time taken for the actual adjustment, however, is much shorter than 50 ms, since the adjustment to the needle bar must be effected during half of a machine revolution when the needle is located above the stitching plate, whilst the adjustment to the feed must be effected in a time period when the feeder is located beneath the stitching plate. With respect to time, the adjustments to these predetermined time intervals are determined by the aforementioned position sensors 8 which register the angular position of the upper arm shaft 9 during each machine revolution and cause setting pulses to be sent to the electromagnets 35 from the electronic unit 6.

Figure 4:
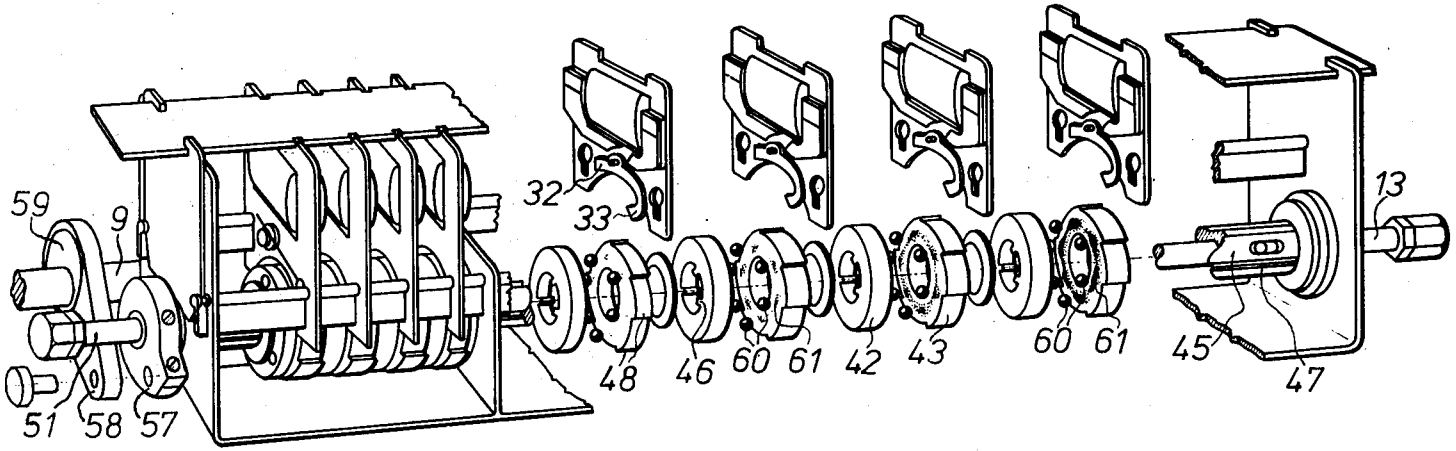
FIG. 4 shows in perspective a code converter forming part of the machine.

FIG. 4 shows a variation of the cam sets, comprising balls 60 in one cam plate and a wave-shaped roller path 61 in the other, in which path the balls are arranged to move when the cam plates of respective cam sets are moved together and the plates rotate relative to each other. This embodiment results in less wear on the cam plates and enables the manufacture of the cam sets to be simplified.

Figures 7, 8:
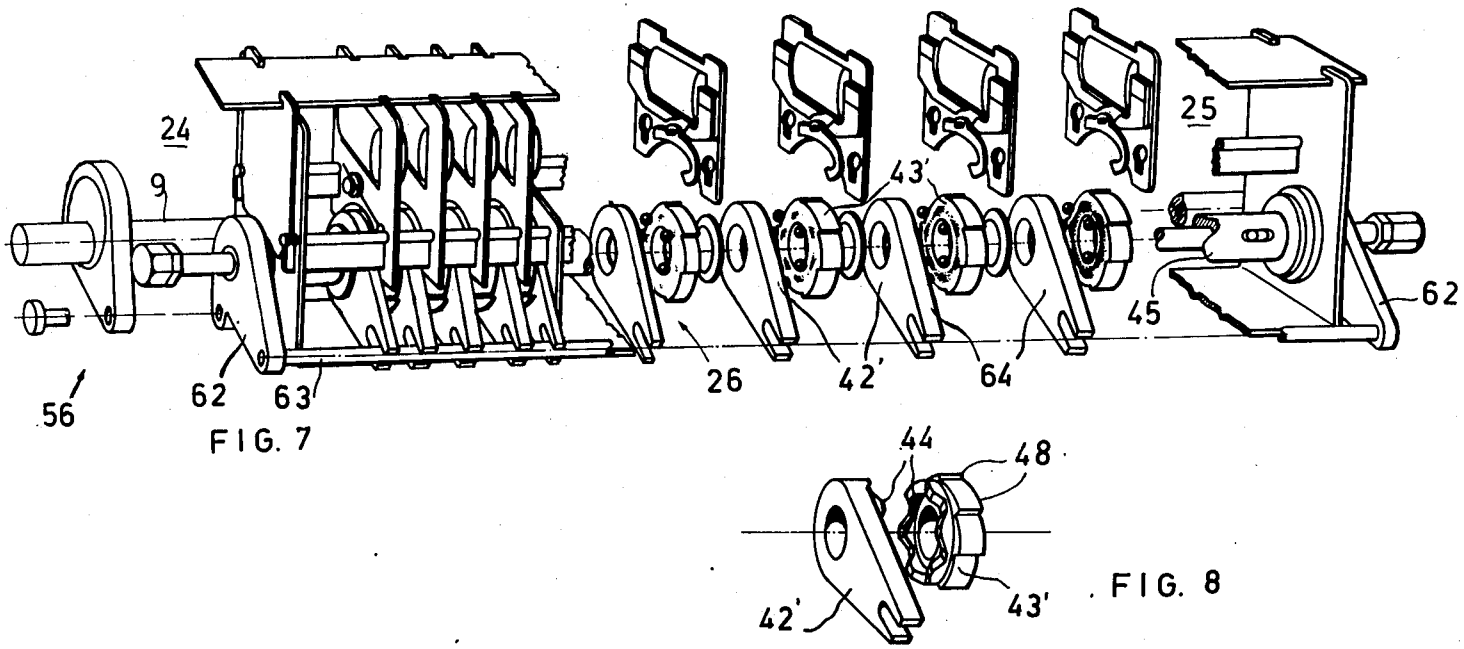
FIG. 7 shows in perspective a variation of the code converter shown in FIG. 4.
FIG. 8 shows an alternative embodiment of a set of cams forming part of the code converter.

In FIG. 7 there is shown a variation of the code converter which has a construction similar to that shown in FIG. 4. Thus, the code converter comprises two sections 24, 25 which in turn comprise cam plate sets 26 in which are included two cam plates 42', 43'. The cam plates are freely mounted on the tubular shaft 45, which in this embodiment is arranged to be stationary throughout. Arranged on an outwardly projecting portion of the shaft 45 at each end of the converter is an angled lever 62. Each lever 62 is driven by a mechanism 56 such as that described in the aforegoing. Together the levers 62 support an operating rod 63 to which the cam plates 42' are connected via arms 64. When the shaft 9 rotates, a pivoting movement is transmitted to the lever 62 and thence, via the rod 63, to the cam plates 42'. The thus produced pivoting movement of the cam plates is identical with that described with reference to the embodiment shown in FIG. 4. The external cam plate drive, used with this embodiment, affords the advantage whereby the plates are not in driving engagement with the shaft 45, and are therefore more readily movable along the same than is the case with the embodiment shown in FIG. 4. A similar external drive can, of course, also be provided for the cam plate sets having cams according to FIG. 6; such a cam set is shown in perspective in FIG. 8.

The described embodiment of the sewing machine serves to exemplify the manner in which the invention can be realised. The invention is not restricted hereto, however, but can be modified within the scope of the invention. For example, the code converter drive means can comprise an indexing mechanism instead of the illustrated crank mechanism. Such indexing movement can be readily effected by means of a so-called Maltese wheel. It should be observed that each of the shown positions of the armature 29 correspond either to the spaced or closed position of the cam plates. Naturally, which of the two latching positions of the armature shall correspond to the open position of the cam plates is a matter of choice. Such variations of the invention shall be considered to be embraced by the scope of the invention as described in the following Claims.

What is claimed is:

1. A sewing machine having a needle bar which is movable in a substantially vertical direction and which is reciprocatingly pivotal about a horizontal axis, a crank mechanism arranged to operate said needle bar connected to a drive shaft arranged in the machine, a shuttle mechanism arranged beneath the needle bar and operable in conjunction therewith to form a stitch, and a reciprocatingly movable cloth-feeding means, a code converter and setting means, said code converter including means for converting a variable binary code to mechanical control movements determined by said setting means, at least one of the reciprocating movements effected by the needle bar and the cloth-feeding means being produced by said code converter for converting a variable binary code to mechanical control movements determined by said setting means, and drive means arranged in the code converter in dependence upon a central control unit which comprises coding means for transmitting binary coded signals to the code converter, said code converter comprising a plurality of sets of cam discs mounted and axially displaceable on a common shaft and individually adjustable with respect to a zero position by said setting means, each set of cam discs being disposed with axial cams facing one another, and stopping means and entrainers cooperating with the setting means, characterized in that said drive means comprises an oscillating motion mechanism means, means transferring limited movements determined by the magnitude of the oscillating motion to a first disc in each set of cam discs, said stopping means and entrainers co-operating with the setting means and being positioned in relation to the magnitude of the oscillating motion in the several cam sets to engage at the ends of the oscillating motion a second disc in each set of cam discs to produce relative movements between the discs in the respective cam sets, said limited movements being transferred as reciprocating movements to at least one of said needle bar and cloth-feeding means, respectively, of the sewing machine.

2. A sewing machine as claimed in claim 1, wherein a central control unit is provided with coding means for zig-zag movement and wherein respective coding means are coordinated for producing zig-zag movements corresponding, at least to a periodically varying seam pattern.

3. A sewing machine as claimed in claim 2, wherein the zig-zag movement converter is provided with actuating means connected to a zig-zag mechanism of said sewing machine and wherein said mechanism is driven in one direction by movement by the converter and in the other direction by movement by springs.

4. A sewing machine as claimed in claim 1, wherein the movement converter actuating means is arranged, in response to the output magnitude of a converter to adjust a lever member which is arranged in the machine in cooperation with a length system and an eccentric drive means is adapted to drive the cloth feeder.

5. A sewing machine as claimed in claim 1, wherein the code converter drive means comprises the axially-arranged cam plate sets mounted on the common shaft which extends to the converter and which is in drive connection with one cam plate in a pair of cam plates in each set and which is imparted a reciprocating rotary movement by means of a crank mechanism which is driven by an eccentric drive means forming part of the drive system of the machine.

6. A sewing machine as claimed in claim 5, wherein the cam disc sets in the converter have individual axial movement lengths which are added upon movements of the actuating means and which in each converter represent 1:2:4 . . . $2^n$ power.

7. A sewing machine as claimed in claim 5, wherein the indexing mechanism comprises a crank mechanism driven by an eccentric drive means forming part of the drive system of the machine, and a lever system including an operating rod to which the driven cam discs are connected by arms.

* * * * *